US011154173B1

(12) United States Patent
Ramsey

(10) Patent No.: US 11,154,173 B1
(45) Date of Patent: Oct. 26, 2021

(54) DUSTING DEVICE

(71) Applicant: Mark C. Ramsey, Omaha, NE (US)

(72) Inventor: Mark C. Ramsey, Omaha, NE (US)

( * ) Notice: Subject to any disclaimer, the term of this patent is extended or adjusted under 35 U.S.C. 154(b) by 57 days.

(21) Appl. No.: 16/791,285

(22) Filed: Feb. 14, 2020

(51) Int. Cl.

| | |
|---|---|
| ***A47L 11/38*** | (2006.01) |
| ***A47L 11/40*** | (2006.01) |
| ***A46B 13/02*** | (2006.01) |
| ***A46B 5/00*** | (2006.01) |

(52) U.S. Cl.
CPC ..... *A47L 11/38* (2013.01); *A46B 5/0083* (2013.01); *A46B 13/02* (2013.01); *A47L 11/4005* (2013.01); *A47L 11/4075* (2013.01); *A46B 2200/3026* (2013.01)

(58) Field of Classification Search
CPC ... A46B 5/0075; A46B 5/0079; A46B 5/0083; A46B 13/00; A46B 13/02; A46B 13/001; A46B 17/02; A46B 2200/3026; A47L 11/10; A47L 11/14; A47L 11/18; A47L 11/19; A47L 11/38; A47L 11/40; A47L 11/4075
USPC ..... 15/23, 28, 49.1, 52.1, 97.1, 98
See application file for complete search history.

(56) References Cited

U.S. PATENT DOCUMENTS

| | | | | |
|---|---|---|---|---|
| 1,692,744 | A * | 11/1928 | Kaplan | A46B 13/02 15/23 |
| 2,702,395 | A * | 2/1955 | Zaiger | A47L 11/4038 15/98 |
| 5,706,541 | A * | 1/1998 | Gutelius | A46B 13/02 15/22.1 |
| 6,295,681 | B1 | 10/2001 | Dolah | |
| 6,374,447 | B1 * | 4/2002 | Armbruster | A46B 13/008 15/144.1 |
| 7,086,115 | B1 | 8/2006 | Rex et al. | |
| 9,586,561 | B1 * | 3/2017 | Nganga | B60S 3/047 |
| D801,608 | S | 10/2017 | Harrington et al. | |
| 2004/0255410 | A1 * | 12/2004 | Schonewille | B08B 1/008 15/29 |
| 2004/0261204 | A1 * | 12/2004 | Pears | A47L 11/38 15/28 |

FOREIGN PATENT DOCUMENTS

| | | |
|---|---|---|
| JP | 54-123252 | * 9/1975 |
| JP | 2000-350688 | * 12/2000 |

* cited by examiner

*Primary Examiner* — Mark Spisich

(74) *Attorney, Agent, or Firm* — Dennis L. Thomte; Thomte Patent Law Office LLC

(57) ABSTRACT

A dusting device comprising an elongated support pole having a lower end and an upper end. An elongated drive mechanism, having a lower end and an upper end is selectively pivotally secured to the upper end of the support pole. The drive mechanism includes an interior compartment which houses a battery and an electrical motor electrically connected to the battery. The electrical motor has a rotatable drive shaft which extends upwardly and outwardly from the upper end of the drive mechanism. A duster is secured to the upper end of the drive shaft for rotation therewith.

4 Claims, 8 Drawing Sheets

DUSTING DEVICE

BACKGROUND OF THE INVENTION

Field of the Invention

This invention relates to a dusting device and more particularly relates to a dusting device which has a duster pivotally and rotatably mounted on the upper end of an elongated support pole.

Description of the Related Art

Many types of hand-held and pole-mounted dusting devices have been previously provided for removing dust or cobwebs from ceilings, walls, ceiling fans, etc. Additionally, dusting devices have been previously provided wherein dusters have been mounted on the upper ends of elongated poles. The prior art dusters are positioned in the area to be dusted and then moved back and forth in that area to dust the same. Also, in some cases, the pole is manually rotated to rotate the duster on the upper end of the pole to dust the area. The prior art dusters are not believed to be pivoted with respect to the longitudinal axis of the pole to enable the dusters to be inserted into areas which are difficult to reach.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The dusting device of this invention includes an elongated support pole, a drive mechanism and a duster. The elongated support pole has a lower end and an upper end, with the upper end of the support pole having an externally threaded portion extending therefrom. The dusting device also includes an elongated support member having a lower end and an upper end with the lower end of the elongated support member having an internally threaded portion which selectively threadably receives the externally threaded portion at the upper end of the support pole. The dusting device also includes a first generally cylindrical-shaped member, with upper and lower sides, at the upper end of the elongated support member. The first generally cylindrical-shaped member has a first bolt opening formed therein which extends between the upper and lower sides thereof.

The drive mechanism includes an elongated housing having a lower end, an upper end and an interior compartment. The lower end of the elongated housing has a second generally cylindrical-shaped member formed therein which has upper and lower sides. The second generally cylindrical-shaped member has a second bolt opening formed therein which extends between the upper and lower sides thereof. The lower side of the second generally cylindrical-shaped member is positioned on the upper side of the first generally cylindrical-shaped member. A pivot bolt extends through the first and second bolt openings so that the lower end of the elongated housing is selectively pivotally secured to the upper end of the elongated support and the support pole.

At least one battery is positioned in the interior compartment of the elongated housing. An electrical motor is also positioned in the interior compartment of the elongated housing and which is electrically connected to the battery in the interior compartment of the elongated housing. The electrical motor has a rotatable drive shaft extending therefrom towards the upper end of the elongated housing. An elongated connector, having inner and outer ends, is rotatably positioned in the upper end of the elongated housing with the inner end of the elongated connector being secured to the rotatable drive shaft of the electrical motor for rotation therewith. The outer end of the elongated connector has external threads formed therewith. A duster is threadably connected to the external threads of the elongated connector for rotation with the drive shaft and the elongated connector.

It is therefore a principal object of the invention to provide an improved dusting device.

A further object of the invention is to provide a dusting device including an elongated support pole having a drive mechanism mounted at the upper end thereof which has an electrical motor positioned therein so that a duster at the upper end of the drive mechanism may be rotated.

A further object of the invention is to provide a dusting device wherein the duster at the upper end of a support pole may be pivotally moved with respect to the support pole.

A further object of the invention is to provide a pole-mounted dusting device having a duster which is pivotally and rotatably mounted on the upper end of an elongated support pole.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
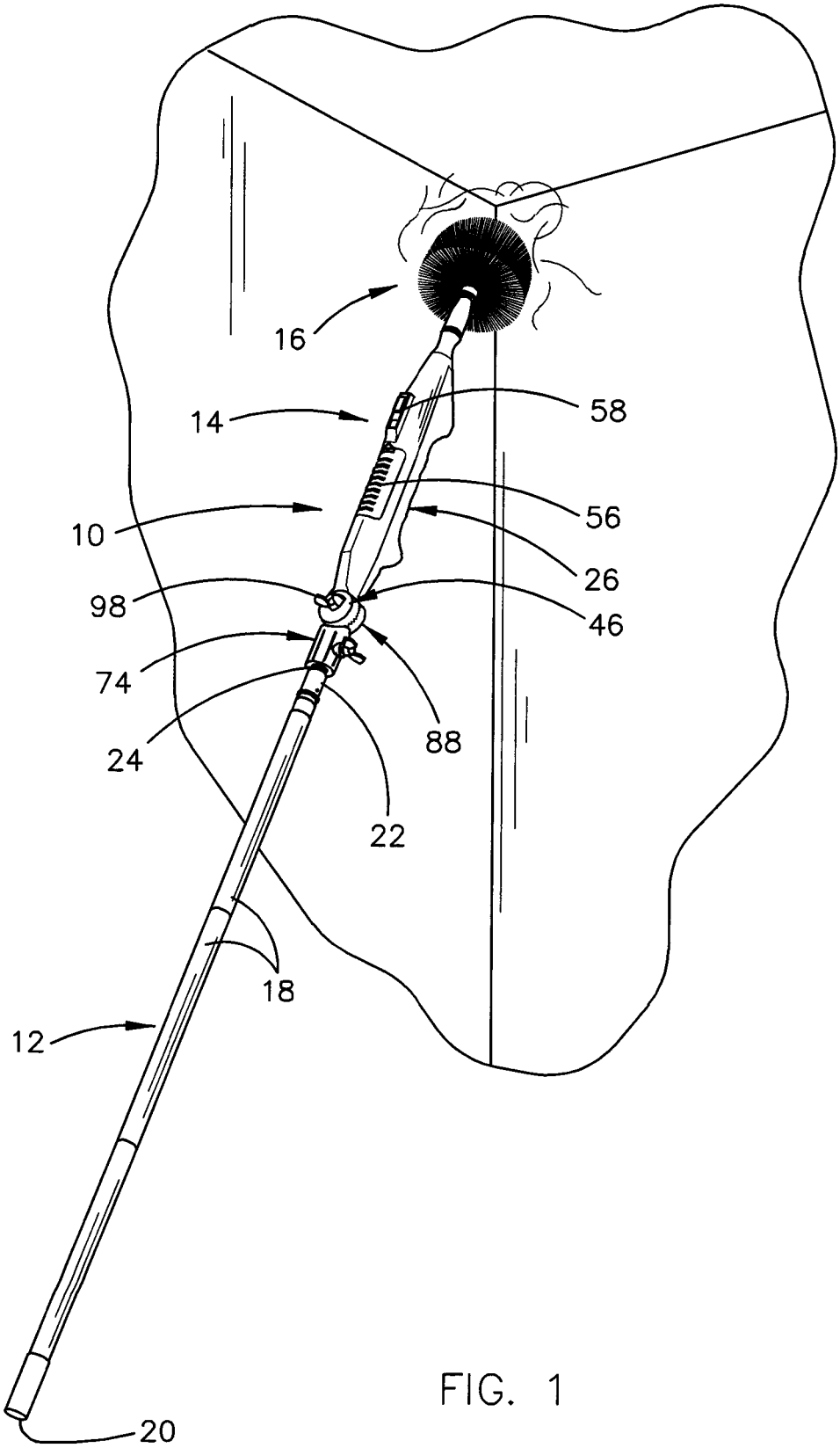
FIG. 1 is a perspective view illustrating the pole-mounted dusting device of this invention being used to dust the upper corners and ceiling of a wall structure.
Figure 2:
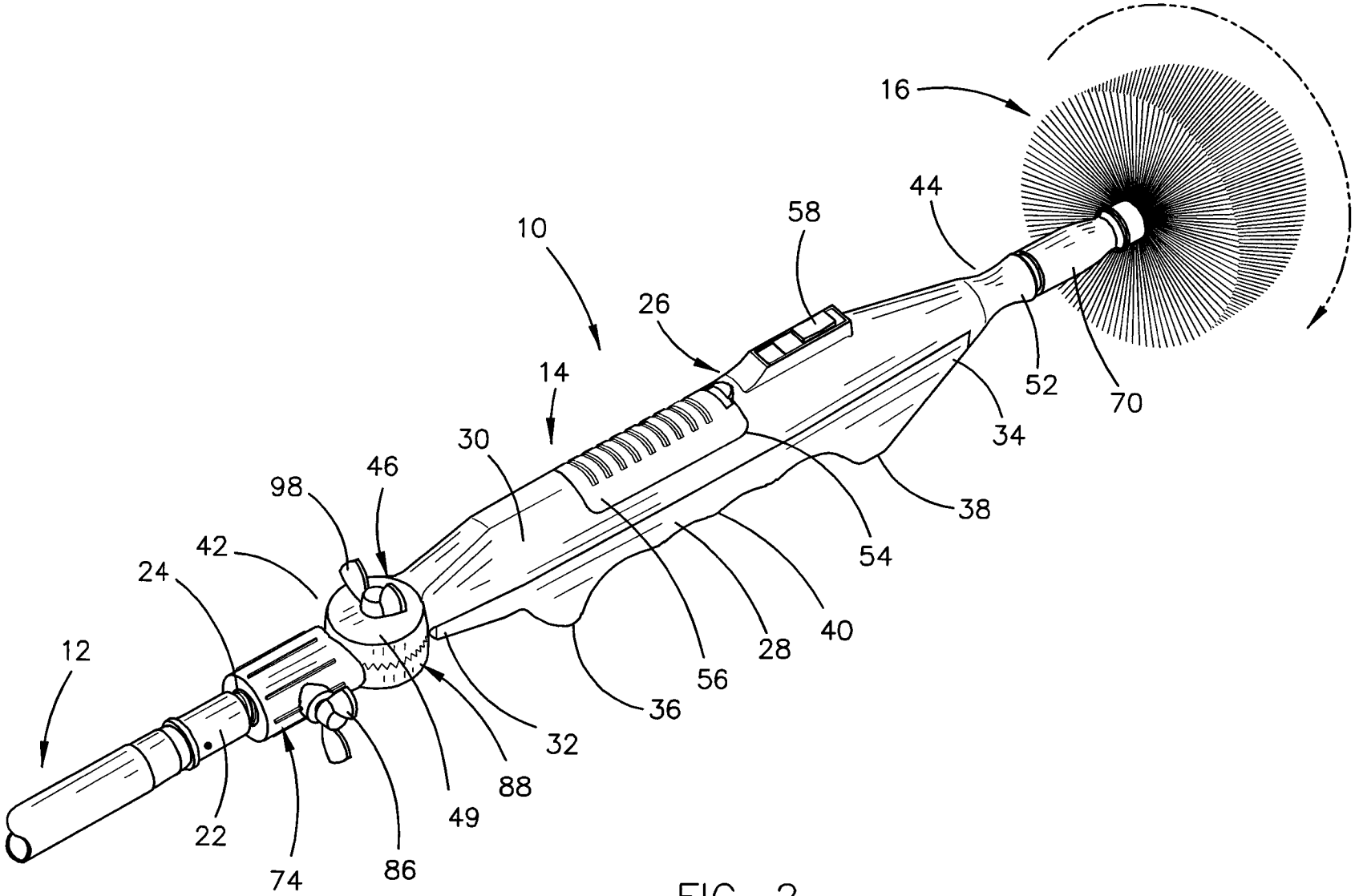
FIG. 2 is a partial perspective view of the pole-mounted dusting device of this invention.
Figure 3:
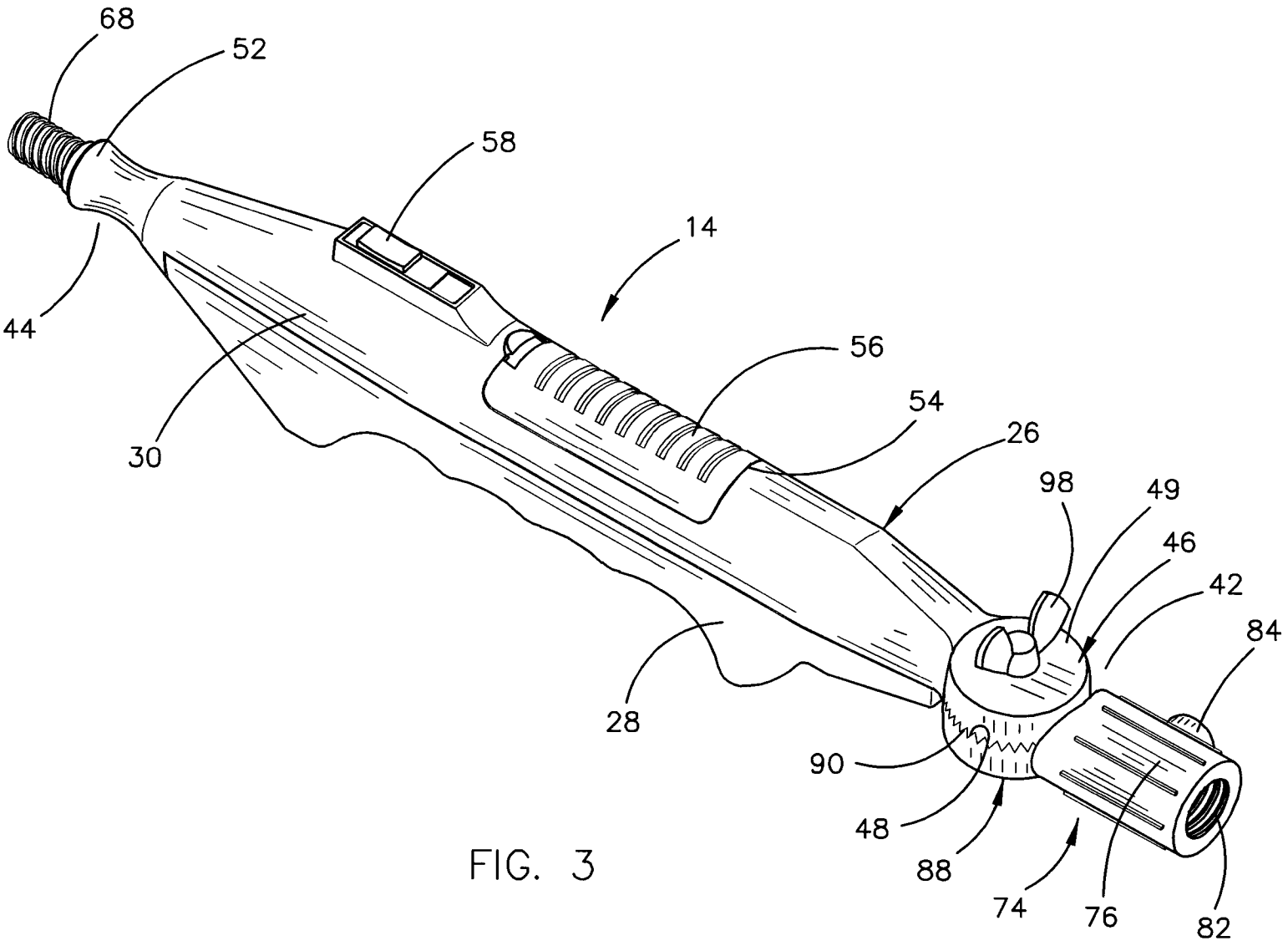
FIG. 3 is a partial perspective view of the pole-mounted dusting device of this invention.
Figure 4:
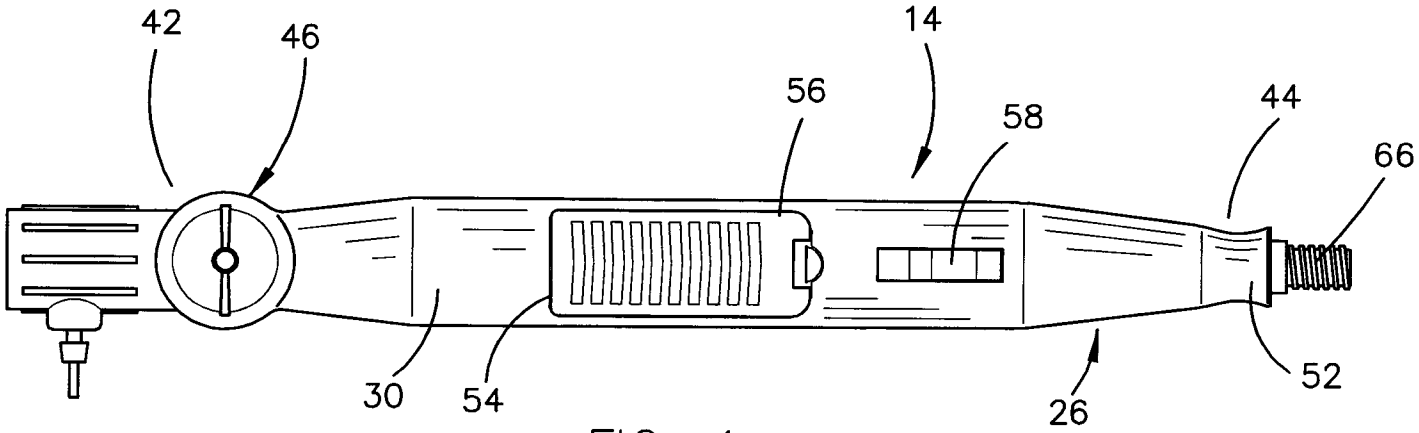
FIG. 4 is a partial top view of the pole-mounted dusting device of this invention.
Figure 5:
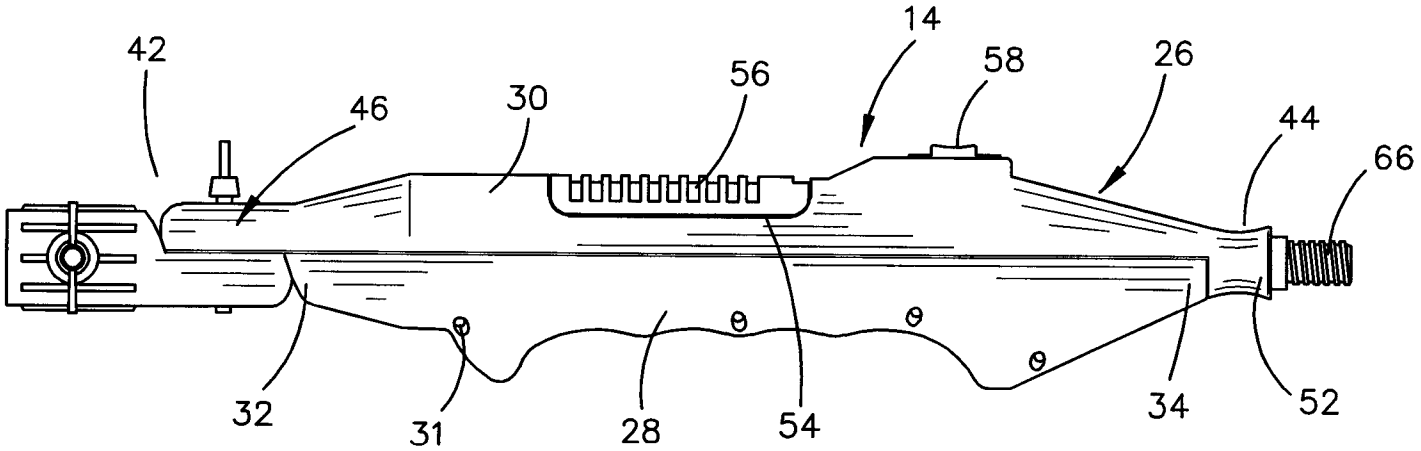
FIG. 5 is a partial side view of the pole-mounted dusting device of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The dusting device of this invention is designated by the reference numeral 10. Dusting device 10 includes 3 major components, namely an elongated support pole 12, a drive mechanism 14 and a duster 16. Support pole 12 may be comprised of a single pole or a plurality of pole sections 18 joined together in an end-to-end manner. The support pole 12 will be described as having a lower end 20 and an upper end 22. The upper end 22 of support pole 12 has an externally threaded portion 24.

Figure 6:
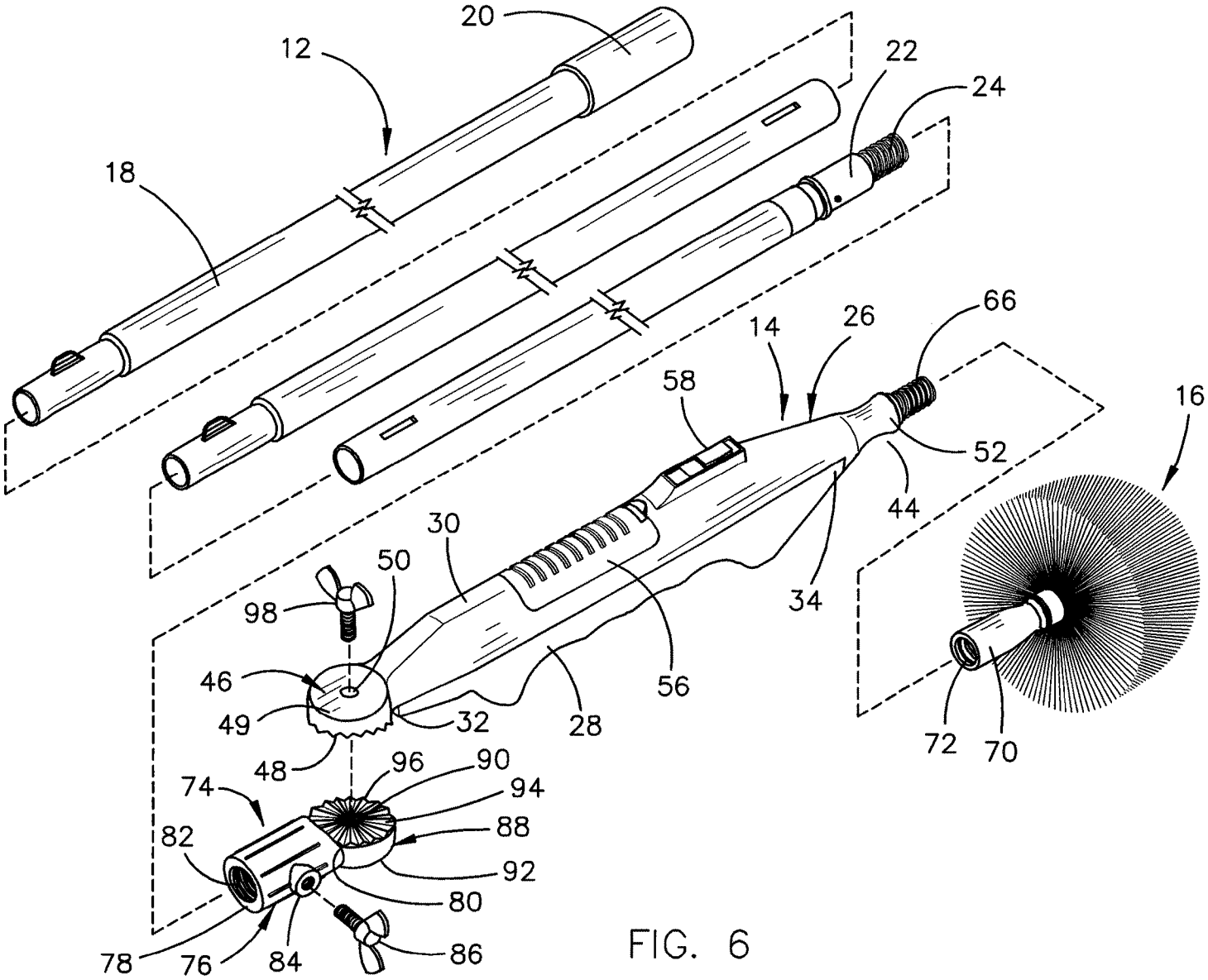
FIG. 6 is an exploded perspective view of the pole-mounted dusting device of this invention.

Drive mechanism 14 includes an elongated housing 26 which is comprised of a lower housing member 28 and an upper housing member 30 which are joined together by any conventional means such as by screws 31. Lower housing member 28 will be described as having a lower end 32 and an upper end 34. Lower housing member 28 has a pair of spaced-apart protrusions 36 and 38 extending therefrom which define a hand gripping portion 40 therebetween. Upper housing member 30 will be described as having a lower end 42 and an upper end 44. The lower end 32 of upper housing member 30 has a generally cylindrical-shaped portion or member 46 formed therein which has an inner face 48 and an outer face 49. Inner face 48 may be smooth or may have a plurality of spaced-apart teeth formed therein such as shown in FIG. 6. Cylindrical member 46 has a bolt opening 50 formed therein which extends between the inner face 48 and the outer face 49 thereof. The upper end 44 of upper housing member 30 has a hollow tubular portion 52 which is positioned at the upper end 34 of lower housing member 28. Upper housing member 30 has a rectangular opening 54 formed therein which is selectively closed by a lid 56. Upper housing member 30 has a sliding switch button 58 mounted thereon which is connected to a switch 60 in housing 26.

One or more of re-chargeable batteries 61 are positioned in the interior compartment of housing 26 and are preferably of the AA type. The on-off switch 60 is electrically connected to the batteries 61 in conventional fashion. The numeral 62 refers to a conventional battery-operated motor which is connected to switch 60 which is connected to switch button 58. Motor 62 has a rotatable drive shaft 64 extending therefrom.

Figure 10:
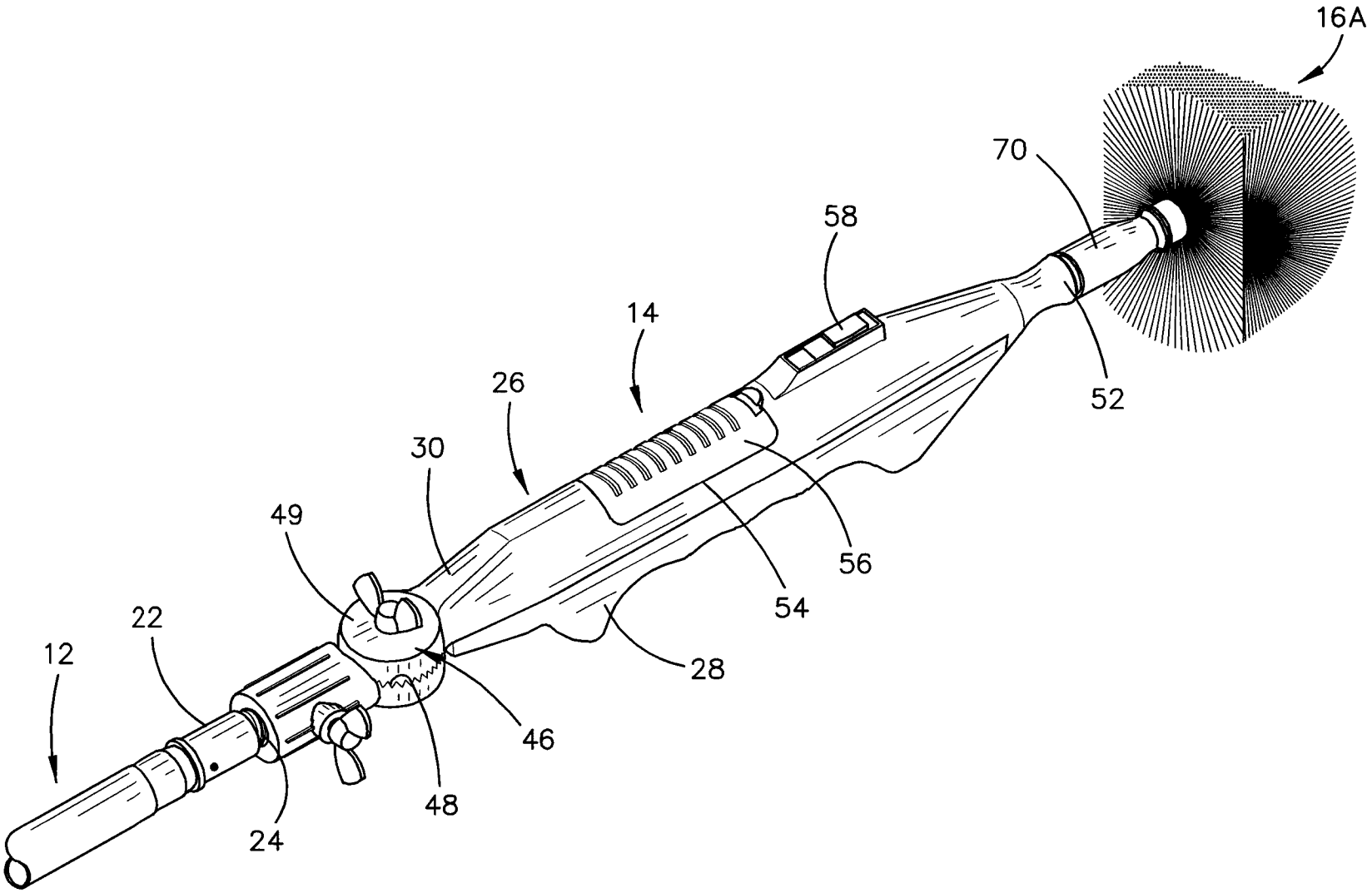
FIG. 10 is a partial perspective view of the pole-mounted dusting device of this invention but which shows a modified duster head.

The upper end of drive shaft 64 is secured to a drive shaft 66 which is rotatably mounted in tubular portion 52 and has an externally threaded portion 68. The duster 16 is of conventional design and which has a shaft or handle 70 extending downwardly therefrom. Shaft 70 has an externally threaded portion 72 which is configured to threadably receive the internally threaded portion 68 of drive shaft 66. A modified form of the duster 16 is shown in FIG. 10 and is designated with 16A. As seen, duster 16A is rectangular in section.

The numeral 74 refers to a connector assembly which pivotally secures the lower end of drive mechanism 14 to the upper end of the support pole 12 as will now be described. Connector assembly 74 includes an elongated tubular portion 76 having a lower end 78 and an upper end 80. Tubular portion 76 has internal threads 82 formed therein which are configured to threadably receive the externally threaded portion 24 of support pole 12. Tubular portion 76 has an internally threaded stud 84 secured to the side thereof which communicates with the interior of tubular portion 76. Stud 74 is configured to threadably receive a wing bolt 86 therein. Connector assembly 74 includes a generally cylindrical-shaped member 88 at the upper end of tubular portion 76 which has an inner face 90 and an outer face 92. Inner face 90 preferably has a plurality of teeth 94 formed therein. However, inner face 90 may be smooth if so desired. Generally cylindrical-shaped member 88 has an internally threaded bolt opening 96 formed therein which extends between inner face 90 and outer face 92.

Figure 7:
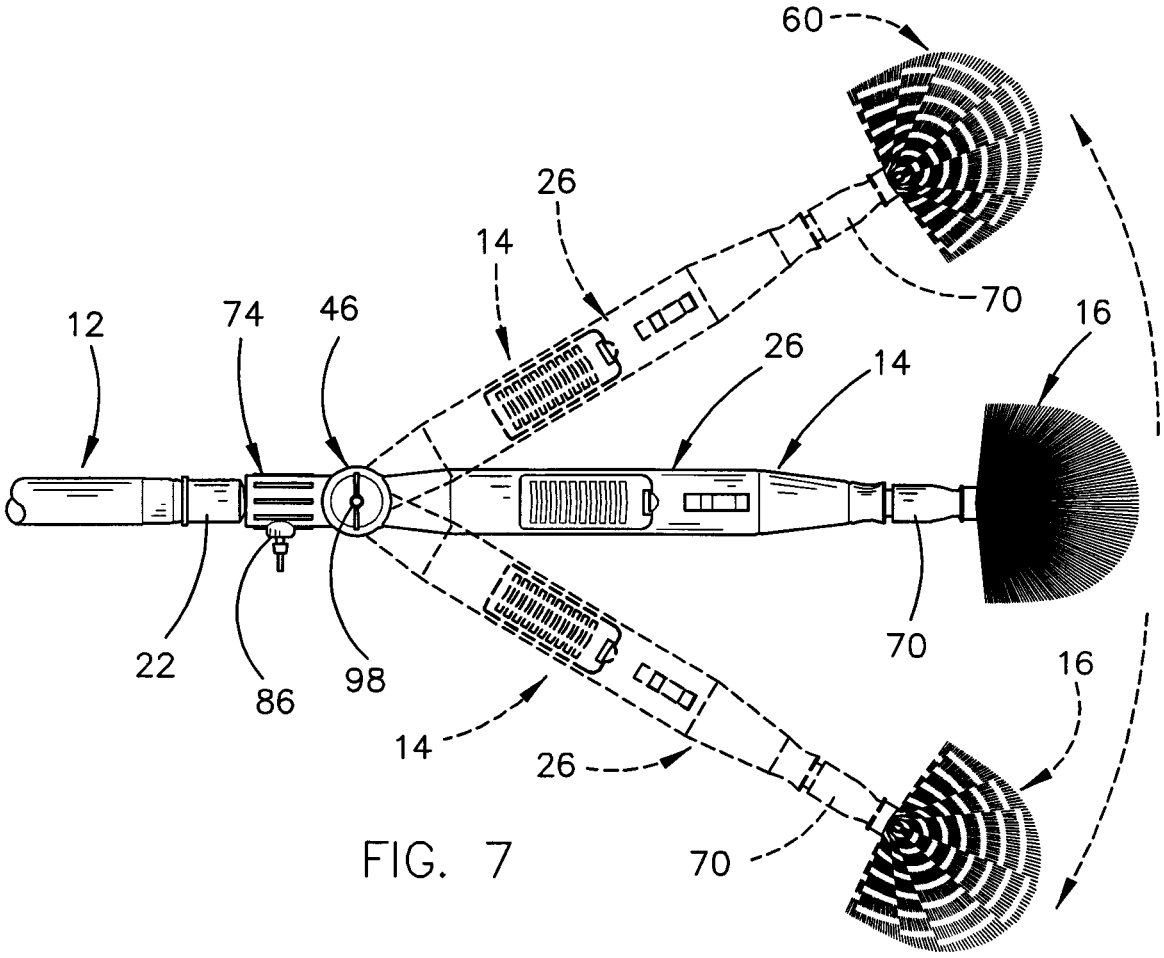
FIG. 7 is a partial top view of the pole-mounted dusting device of this invention with the broken lines illustrating how the upper end of the device may be pivoted with respect to the support pole of the invention.
Figure 8:
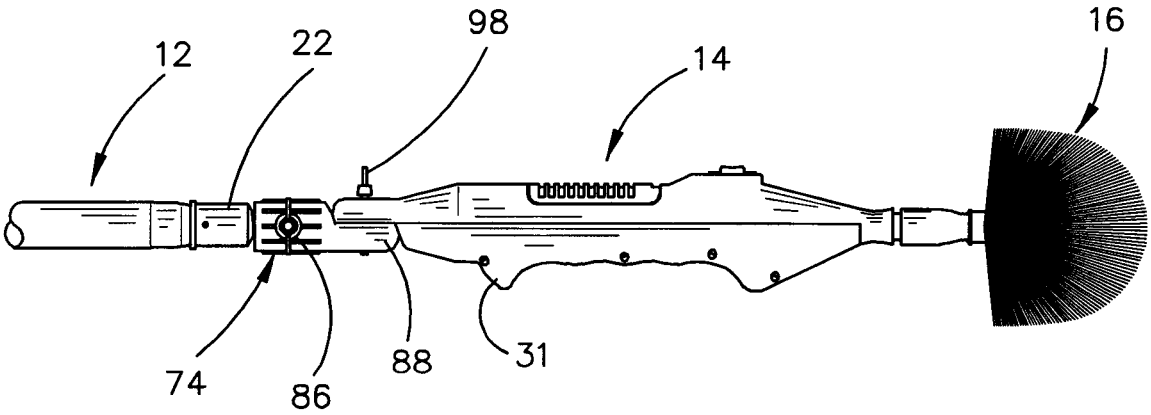
FIG. 8 is a partial side view of the upper portion of the pole-mounted dusting device of this invention.
Figure 9:
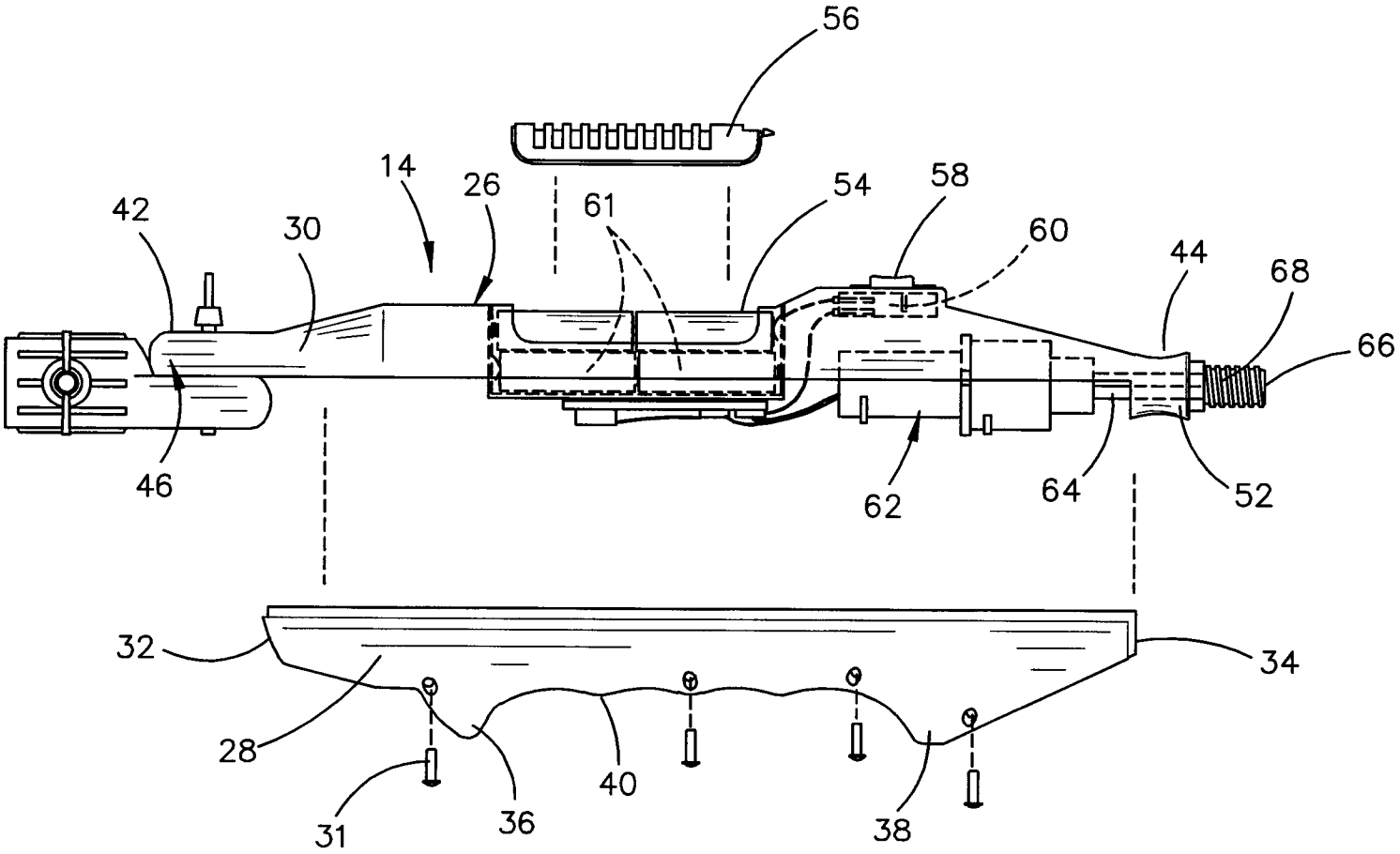
FIG. 9 is an exploded side elevational view of the pole-mounted dusting device of this invention.

Connector assembly 74 is selectively pivotally secured to generally cylindrical-shaped member 46 as follows. Inner face 48 of member 46 is positioned on inner face 90 of connector assembly 74. Threaded wing bolt 98 is then extended downwardly through opening 50 of member 46 and threadably inserted into internally threaded bolt opening 96 of connector assembly. When bolt 98 is tightened, drive mechanism 14 may be selectively pivoted with respect to support pole 12. When bolt 98 is loosened, drive assembly 14 may be selectively pivoted with respect to support pole 12 such as seen in FIG. 7. When so positioned, the wing bolt 96 is tightened to maintain said drive mechanism 14 and duster 16 in the desired position to enable the duster 16 to be able to be positioned into areas otherwise inaccessible.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A dusting device, comprising:

an elongated support pole having a lower end and an upper end;

said upper end of said support pole having an externally threaded portion extending therefrom;

an elongated support member having a lower end and an upper end;

said lower end of said elongated support member having an internally threaded portion which selectively threadably receives said externally threaded portion at said upper end of said support pole;

a first generally cylindrical-shaped member, with upper and lower sides, at said upper end of said elongated support member;

said first generally cylindrical-shaped member having a first bolt opening formed therein which extends between said upper and lower sides thereof;

an elongated housing having a lower end, an upper end and an interior compartment;

a second generally cylindrical-shaped member, with upper and lower sides, at said lower end of said elongated housing;

said second generally cylindrical-shaped member having a second bolt opening formed therein which extends between said upper and lower sides thereof;

said lower side of said second generally cylindrical-shaped member being positioned on said upper side of said first generally cylindrical-shaped member;

a pivot bolt extending through said first and second bolt openings whereby said lower end of said elongated housing is selectively pivotally secured to said upper end of elongated member about said pivot bolt;

at least one battery positioned in said interior compartment of said elongated housing;

an electrical motor positioned in said interior compartment of said elongated housing and which is electrically connected to said at least one battery in said interior compartment of said elongated housing;

said electrical motor having a rotatable drive shaft extending towards said upper end of said elongated housing;

an elongated connector, having inner and outer ends, rotatably positioned in said upper end of said elongated housing;

said outer end of said elongated connector having external threads formed therewith;

said inner end of said elongated connector being secured to said rotatable drive shaft for rotation therewith;

and a duster threadably connected to said external threads of said elongated connector for rotation with said drive shaft and said elongated connector.

2. The dusting device of claim 1 wherein said elongated housing includes an elongated lower housing member and an elongated upper housing member secured to said lower housing member.

3. The dusting device of claim 2 wherein said upper housing member has an interior compartment access opening formed therein which is selectively closed by a lid member.

4. A dusting device, comprising:

an elongated support pole having a lower end and an upper end;

a drive mechanism having an upper end and a lower end;

said drive mechanism including an elongated housing having a lower end, an upper end and an interior compartment;

said lower end of said elongated housing being operatively selectively removably secured to said upper end of said support pole;

said lower end of said elongated housing being selectively pivotally secured to said upper end of said support pole;

said elongated housing including an elongated lower housing member, having an upper side and a lower side, and an elongated upper housing member secured to said upper side of said lower housing member;

said lower side of said lower housing member having a pair of spaced-apart protrusions extending therefrom which define a hand gripping portion therebetween;

at least one battery positioned in said interior compartment of said elongated housing;

an electrical motor positioned in said interior compartment of said elongated housing which is electrically connected to said at least one battery;

said electrical motor having a rotatable drive shaft extending upwardly therefrom and outwardly of said upper end of said elongated housing;

an on-off switch mounted on said elongated housing for controlling said electrical motor;

a duster spaced from said upper end of said elongated housing; and said duster being secured to said rotatable drive shaft for rotation therewith.

* * * * *